US007854426B2

(12) United States Patent
Honegger

(10) Patent No.: US 7,854,426 B2
(45) Date of Patent: Dec. 21, 2010

(54) METHOD AND DEVICE FOR INSCRIBING PRINTED PRODUCTS

(75) Inventor: Werner Honegger, Bach (CH)

(73) Assignee: Ferag AG, Hinwil (CH)

( * ) Notice: Subject to any disclaimer, the term of this patent is extended or adjusted under 35 U.S.C. 154(b) by 359 days.

(21) Appl. No.: 11/590,633

(22) Filed: Oct. 31, 2006

(65) Prior Publication Data

US 2007/0096378 A1 May 3, 2007

(30) Foreign Application Priority Data

Oct. 31, 2005 (CH) ..... 1742/05

(51) Int. Cl.
*B65H 5/30* (2006.01)

(52) U.S. Cl. ..... 270/52.3; 270/1.01; 270/52.14; 270/52.26; 270/52.29

(58) Field of Classification Search ..... 270/1.01, 270/12, 15, 17, 18, 52.14, 52.26, 52.29, 52.3
See application file for complete search history.

(56) References Cited

U.S. PATENT DOCUMENTS 4,395,031 A * 7/1983 Gruber et al. ..... 270/52.29
4,538,161 A * 8/1985 Reist ..... 347/4
4,732,374 A * 3/1988 Honegger ..... 270/52.3
5,161,790 A 11/1992 March
5,596,932 A * 1/1997 Honegger ..... 101/485
5,810,345 A * 9/1998 Lehmann et al. ..... 270/52.26
5,975,182 A * 11/1999 Hartmann et al. ..... 156/538

FOREIGN PATENT DOCUMENTS

EP 0 096 228 A2 12/1983
EP 0 096 228 A3 12/1983
EP 0 709 326 A1 5/1996

OTHER PUBLICATIONS

International/European Search Report (in German).

* cited by examiner

*Primary Examiner*—Leslie A Nicholson, III
(74) *Attorney, Agent, or Firm*—Brinks Hofer Gilson & Lione

(57) ABSTRACT

An apparatus (10) for inscribing folded printed products (12) having a first product part (14) and a second product part (16) joined together by a fold (18). The printed products (12) are conveyed by a conveyor device (22), with the fold (18) astride receiving saddles (26) disposed transversely to the direction of conveyance (F), through an inscribing section (30) to which a inscribing station (60) is assigned. For the inscribing of an outer side (56) of the first product part (14) disposed in leading arrangement in the direction of conveyance (F), a region (66) of the outer side (56) comes into contact with a fixed support surface (58) assigned to the inscribing section (30) and is inscribed by the inscribing station (60). For the inscribing of an inner side (48) of the second product part (16), the first product part (14) is respectively raised from a supporting member (38), assigned at least in the inscribing section (30) to the receiving saddles (26), such that a region (78) of the inner side (48) of the second product part (16) is exposed and this exposed region (78) comes to bear upon the support surface (58) and can hence be inscribing by the inscribing station (60).

18 Claims, 1 Drawing Sheet

METHOD AND DEVICE FOR INSCRIBING PRINTED PRODUCTS

RELATED APPLICATION

This application is related to Switzerland Application No. 01/742,105 filed Oct. 31, 2005, and claims priority therefrom.

FIELD OF INVENTION

The present invention relates to a method and device or apparatus for inscribing printed products.

BACKGROUND OF THE INVENTION

From document EP 96228 A, a device for addressing newspapers, magazines and the like is known. The device has a conveyor apparatus having grabs which are spaced apart in a direction of conveyance and which respectively hold a printed product by its fold and transport it obliquely rearward in hanging arrangement with the fold running transversely to the direction of conveyance. In a inscribing station, a trailing end region of the printed product, lying opposite the fold, rests respectively on a supporting slide rail. The printed products are addressed, in their regions bearing against the slide rails, on the outer side of the leading product part viewed in the direction of conveyance.

From document EP 709326 A, a method and an apparatus for inscribing folded printed products on an innermost side is known. A printed product here consists of a first product part joined by a fold to a second product part. The apparatus has a conveyor device, which is provided with grabs such that it grabs the respective printed product in the region of the fold and transports it in the longitudinal direction along a print station with the fold running transversely to the direction of conveyance. The printed products are transported hanging from the grabs, so that a free margin of the respective product parts points downward in the direction of the print station. The trailing, second product part additionally has a prefold, whereby the free margin of the second product part juts over the free margin of the leading, first product part. Since the printed products are held by the fold, the first product part bears against the second product part before being lifted therefrom for printing purposes. For the purpose of lifting the two product parts one away from the other, in a section upstream of the print station an opening device which engages in the region of the free margins of the printed products and is in the form of a spiral, the spiral axis of which runs in the direction of the direction of conveyance of the conveyor device, is disposed beneath the conveyor device. As a result of the rotatable spiral, the first and second product part are now distanced from one another during the conveyance, in the region of the free margin, by the spiral acting upon the prefold of the second product part. Downstream viewed in the direction of conveyance, a fixed guide rail is disposed in such a way beneath the conveyor device that it reaches into the region of the spiral. The guide rail is shaped such that, from round about the middle, it steadily approaches the spiral toward the end of the spiral of the conveyor device viewed in the direction of conveyance and, in the region of the print station, runs parallel to the conveyor device. The printed products pre-opened by the spiral are hence further opened in the ascending region of the guide rail, whereby, on the inner side of the first and on the inner side of the second product part a band-shaped region comes to bear against the guide rail and is printed on at the print station.

With the abovementioned apparatuses, it is consequently possible to address or inscribe the printed products either only on an outer side or only on an inner side.

SUMMARY OF THE INVENTION

An object of the present invention is to refine the known method and the apparatuses of the generic type such that both an inscribing on an inner side and a inscribing on an outer side of the printed products are possible.

These objects are respectively achieved with a method according to the invention as claimed in patent claim 1 and an apparatus according to the invention as claimed in patent claim 4. The fact that the printed products are conveyed in the direction of conveyance astride receiving saddles disposed transversely to the direction of conveyance and that, for the inscribing on an inner side of a second product part which trails behind in the direction of conveyance, a leading, first product part is raised by means of a supporting member, allows a region of the inner side of the second product part to be exposed. This exposed region comes to bear upon a support surface assigned to the inscribing section and can be printed.

A preferred embodiment of the method according to the invention is described in claim 2. The effect of the second product part being able to rest on a further supporting member is that the first product part, for inscribing, is relieved of load on its outer side.

A further preferred embodiment of the method according to the invention is described in claim 3. Due to the rotatability of the receiving unit about a rotation axis, the receiving unit can be brought into one rotational position for the inscribing of the inner side of the second product part and can be brought into a further rotational position for the inscribing of the outer side of the first product part.

Further characteristics and advantages of the present invention become clear from the following description and the figures, which latter are intended to serve merely as illustrative examples of the written comments.

BRIEF DESCRIPTION OF THE DRAWINGS

In purely diagrammatic representation.

DETAILED DESCRIPTION OF THE PREFERRED EMBODIMENTS

Figure 1:
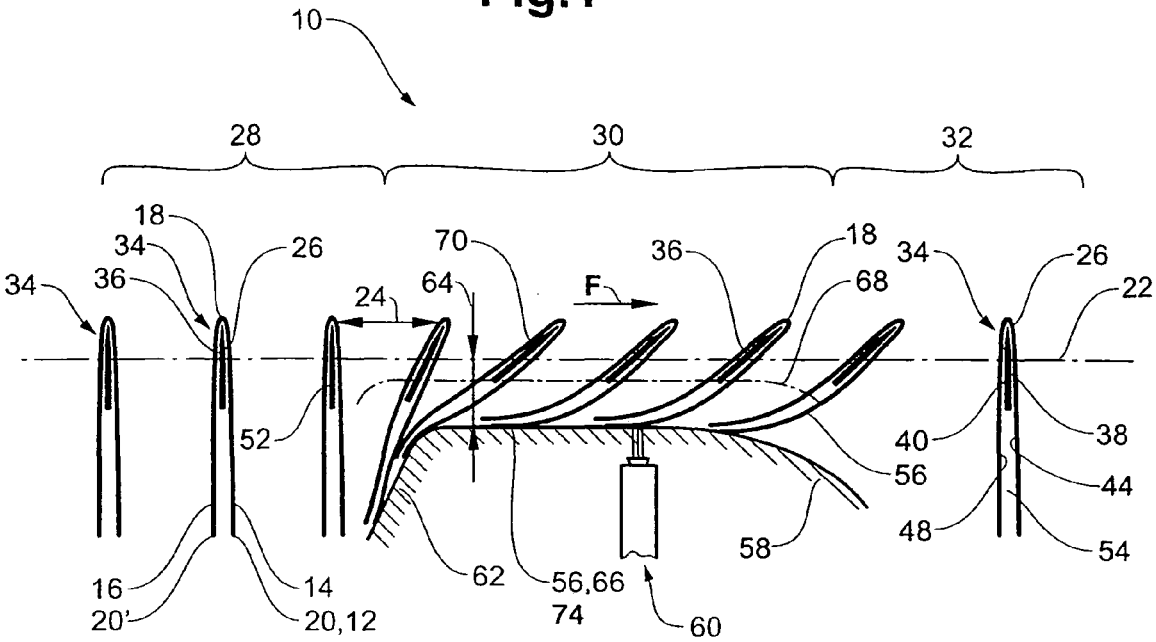
FIG. 1 shows a simplified side view of an apparatus according to the invention for use in inscribing an outer side of a first product part of the printed product.

FIG. 1 shows an embodiment of an apparatus 10 according to the invention, which, for the sake of better representation of the features, is represented in a simplified side view. The apparatus 10 serves to inscribe folded printed products 12 respectively having a first product part 14 and a second product part 16 respectively joined together by a fold 18, each product part 14, 16 having a free margin 20, 20' running at least approximately parallel to the fold 18.

The apparatus 10 comprises a conveyor device 22, which conveys in a circulatory manner in a direction of conveyance F and in which the printed products 12 are disposed one behind the other at a distance apart 24 and with the fold 18 running transversely to the direction of conveyance F. For this purpose, the conveyor device 22 can be configured similarly to the accumulating conveyor disclosed in document EP 95603 A. The conveyor device 22 has receiving saddles 26, which are disposed one behind the other at a distance apart 24 transversely, in the present case at right angles, to the direction of conveyance F and which are intended to convey the printed products 12 deposited astride them in the region of the fold 18 one after another through a preliminary section 28, an inscribing section 30 and a finishing section 32.

The receiving saddle 26 is respectively assigned to a receiving unit 34, which, in addition to the receiving saddle 26, has a rotation axis 36, on which the receiving unit 34 is disposed in rotatably mounted arrangement. The rotation axis 36 runs substantially parallel to the receiving saddle 26 and is disposed approximately in the middle of the receiving unit 34. To each receiving unit 34 there is additionally respectively assigned, with respect to the direction of conveyance F, a planar, leading supporting member 38 and a planar, trailing further supporting member 40. The receiving unit 34 has a cross-sectional profile in the form of an isosceles triangle, on which the printed product 12 rests such that the leading, first product part 14 and the trailing, second product part bear respectively against the equal-length sides of the triangle. The receiving saddle 26 receives the fold 18 of the printed product 12 and is therefore rounded in an edge region lying opposite the fold 18. It is conceivable, of course, for the receiving unit 34 to have a rectangular cross-sectional profile and for an edge region lying opposite the fold 18 to be appropriately rounded.

The equal-length sides of the isosceles-triangular cross section are formed in the present case by the supporting members 38, 40, which are disposed such that the supporting member 38 supportively interacts with an inner side 44 of the first product part 14 and the further supporting member 40 supportively interacts with an inner side 48 of the second product part 16. A full-faced configuration of the supporting members 38, 40 is advantageous when the printed products 12 are laid on the receiving unit 34, since the printed products 12 are guided better. Alternatively to this, it is conceivable for the supporting members 38, 40 not to have a full-faced, but rather a rail-like configuration.

From FIG. 1 it can further be seen that a height 52 of a receiving unit 34 takes up approximately one-third to a half of a distance between the fold 18 and the free margin 20, 20' of the printed product 12. The residual part 54, which does not bear against the receiving unit 34, of the respective first product part 14 and of the respective second product part 16 hence remains broadly freely movable and is thus in certain fashion flexible for further working.

According to the tilt of the receiving units 34 about the assigned rotation axis 36, it is now possible with the same apparatus 10 to perform, on the one hand, an inscribing on an outer side 56 of the leading, first product part 14 and, on the other hand, an inscribing on the inner side 48 of the trailing, second product part 16.

In the inscribing section 30 there is fixedly disposed a supporting element forming a support surface 58, for example in the form of a supporting plate or a supporting rail, as well as an inscribing station 60. The support surface 58 disposed beneath the conveyor device 22 has an ascending ramp 62, facing the preliminary section 28, runs in the adjoining region of the inscribing station 60, provided with at least one print head, substantially parallel and at a distance 64 to the conveyor device 22 and subsequently slopes down again on a side of the support surface 58 facing the finishing section 32.

FIG. 1 shows that, in the apparatus 10, the printed products 12 in the preliminary section 28 hang freely on the vertically disposed receiving saddles 26 of the receiving unit 34. During the passage from the preliminary section 28 to the inscribing section 30, the outer side 56 of the first product part 14 comes into contact with the support surface 58 and the free margin 20 assigned to the first product part 14 and a region 66, adjacent thereto, of the outer side 56 of the first product part 14 remains in bearing contact with the support surface 58 while the printed product 12 is drawn by the conveyor device 22, for printing, over the mound-shaped support surface 58.

For the inscribing of the outer side 56 of the first product part 14, the receiving unit 34 in the inscribing section 30 is tilted in such a way about the rotation axis 36 (in FIG. 1 in the clockwise direction) that the second product part 16 of the printed product 12 is supported on its inner side 48 by the further supporting member 40 and the first product part 14 rests on the support surface 58. The rotational position of the receiving units 34 relative to the rotation axes 36 is achieved by the receiving units 34 being controlled by means of a link motion 68, which is likewise assigned to the apparatus 10 and which in FIG. 1, for the sake of clarity, is represented in a stylized manner merely by a dash-dot line. In this context, it is also conceivable, however, for the rotational position of the receiving units 34 to be controlled, instead of by a connecting link guide 68, by electronic, hydraulic or pneumatic means.

For the inscribing of the outer side 56 of the first product part 14, the receiving unit 34 is rotated in such a way about the rotation axis 36 that a surface area 70 of the second product part 16, which surface area is supported by the further supporting member 40, slopes substantially obliquely rearward in relation to the direction of conveyance F. As the transport by the conveyor device 22 progresses, the printed products 12, in the region of the outer side 56 of the first product part 14, hence bear against the support face 58 such that the substantially band-shaped region 66 adjoining the free margin 20 can be inscribing by the inscribing station 60.

To this effect, the inscribing station 60, which is generally known, is disposed substantially at right angles to the support surface 58. The inscribing of the printed products 12 in the inscribing region 74 is realized in the direction of the direction of conveyance F, whereby the inscribing direction takes substantially the same path as the other inscribing direction of the printed product 12, or is identically aligned.

Having been inscribed by the inscribing station 60, the printed products 12 guided by the receiving units 34 slide partially along the gradually sloping support surface 58 and, as the receiving unit 34 is simultaneously tilted back, are thus successively restored to that position in the finishing section 32 in which they were previously found in the preliminary section 28.

Figure 2:
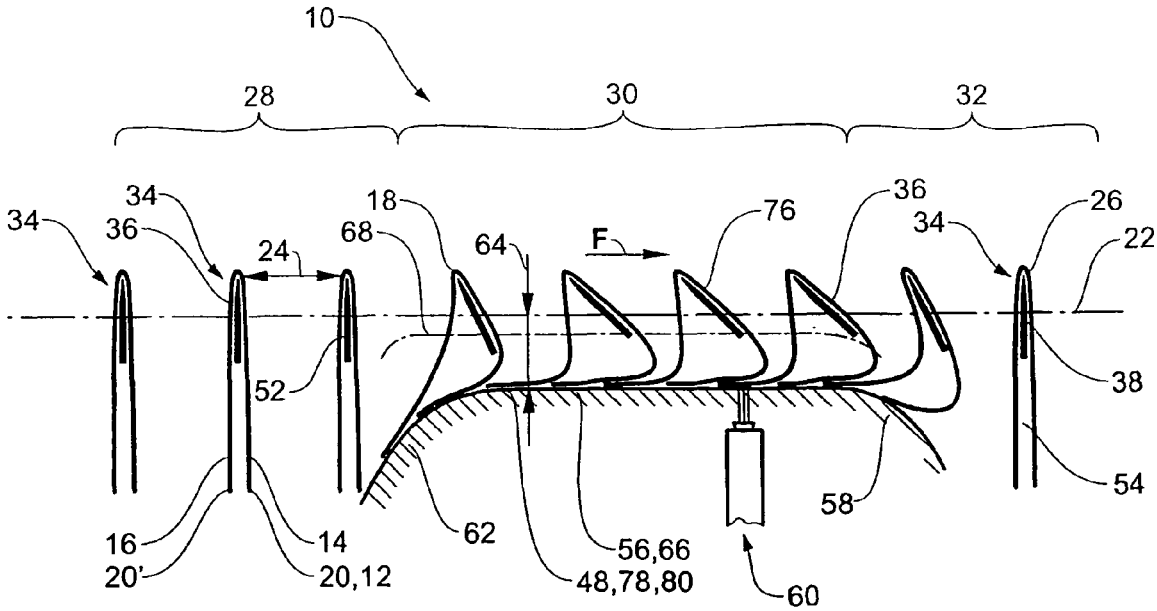
FIG. 2 shows a simplified side view of the apparatus shown in FIG. 1 for use in inscribing an inner side of a trailing, second product part.

The apparatus shown in FIG. 2 is the same apparatus 10 as shown in FIG. 1. Unlike in FIG. 1, the receiving units 34 in the inscribing section 30, for the inscribing of the inner side 48 of the second product part 16, are now tilted in an opposite direction about the rotation axes 36 assigned to them (in FIG. 2, counterclockwise).

FIG. 2 shows that, in the apparatus 10, the printed products 12 in the preliminary section 28 hang freely on the vertically disposed receiving saddles 26 of the receiving unit 34. As previously, when this apparatus 10 is in operation, during the passage from the preliminary section 28 to the inscribing section 30, the outer side 56 of the first product part 14 comes into contact, in a region 66 adjacent to the free margin 20, with the ramp 62 of the support surface 58. As the printed products 12 are increasingly conveyed in the direction of conveyance F, the receiving units 34 in the inscribing section 30, for the inner inscribing of the second product part 16, are tilted in such a way about the respective rotation axes 36 that the first product part 14 is raised or raised up from the leading supporting member 38 and hence a further surface area 76, supported by the supporting member 38, of the printed product 12 is aligned in relation to the direction of conveyance F such that it slopes substantially obliquely forward. As the receiving unit 34, upon entering the inscribing section 30, is tilted into the rotational position shown in FIG. 2, the first product part 14 is displaced relative to the second product part 16 such that a band-shaped region 78 of the inner side 48 of the second product part 16, which region adjoins the free margin 20', is exposed by the free margin 20 of the first product part 14 being pulled away from the free margin 20' of the second production part 16 as a result of the raising induced by the tilting of the receiving unit 34 and the thereby conditioned path requirement in the direction of conveyance F. This exposed region 78 of the inner side 48 of the second product part 16 thereby comes to bear upon the support surface 58 and can hence be printed inscribing station 60, in a further inscribing region 80 disposed therein, as it is drawn along the support surface 58.

Having been inscribed the inscribing station 60, the printed products 12 guided by the receiving units 34 slide partially along the gradually sloping support surface 58 and, as the receiving unit 34 is simultaneously tilted back, are thus successively restored to that position in the finishing section 32 in which they were previously found in the preliminary section 28.

It is thus conceivable for the supporting members 38, 40 assigned to the receiving saddles 26 not to be assigned to the receiving unit 34, but rather to a separate supporting device, the supporting members 38, 40 being introduced, for example, laterally into the folded printed products 12.

It is further conceivable for the supporting region 58, in the region of the inscribing station 60 or inscribing section 30, to be configured such that it runs not parallel or only partially parallel to the conveyor device 22.

It is likewise conceivable for the receiving units 34 to arrive in the inscribing section 30 already in a rotational position suitable for inscribing the printed products 12 on either the outer side or the inner side.

It is also conceivable for the support surface 58 to be formed by a multiplicity of sub elements, for example by rolling elements.

In addition, it is conceivable for the respective supporting members 38, 40 to be likewise adjustable within the receiving unit 34.

It is further conceivable for the rotation axis 36 to be able to be disposed closer to the receiving saddle 26 or further away therefrom, as shown in FIG. 1 and 2. It is also conceivable for the rotation axis 36 to be disposed outside the receiving unit 34, running parallel to the receiving saddle 26.

It may similarly be imagined that the inscribing of the printed products 12 is realized in the transverse direction, i.e. running in the direction of the fold 18.

It is further conceivable for the receiving saddles 26 to be disposed on the conveyor device 22 obliquely to the direction of conveyance F.

It is further conceivable for the distance 24 between the receiving saddles 26 of the conveyor device 22 to be enlarged relative to the represented embodiment such that the second product part 16 of a leading printed product 12 does not overlap the first product part of the trailing printed product 12'. It would thus be possible to perform a printing on the outer side 56 of the first product part 14 in an enlarged inscribing region 74 and a inscribing in an enlarged, further inscribing region 80 of the inner side 48 of the second product part 16 with the same tilt position of the receiving unit 34. Were the distance 24 between the receiving saddles 26 of the conveyor device 22 to be enlarged such that it substantially corresponds to the distance between the fold 18 and the free margin 20, 20' of the printed product 12, the band-shaped region 66 on the outer side 56 of the first product part 14 could extend virtually from the free margin 20 of the first product part 14 to the fold 18. A variable distance 24 between the receiving saddles 26 of the conveyor device 22 could be realized, for example, with means according to the disclosure in DE 19649092 A.

Self-evidently, the inscribing apparatus according to the invention can be arranged singly or plurally, in isolation or together with other work stations, along the conveyor device.

The invention claimed is:

1. A method for inscribing folded printed products which have a first product part and a second product part joined together by a fold, and each product part having a free margin running at least approximately parallel to the fold, comprising the steps of:

conveying the printed products one behind the other and with the fold running transversely to a direction of conveyance in the direction of conveyance through an inscribing section by means of a conveyor device having receiving saddles disposed transversely to the direction of conveyance, the printed products being deposited astride the receiving saddles;

drawing the printed products by means of the receiving saddles in the inscribing section over a support surface, the printed products thereby bearing upon the support surface;

for inscribing on an inner side of the second product part which trails behind in the direction of conveyance (F), raising the leading first product part by means of a supporting member supporting the first product part at an inner side of the first product part at a height, as measured from the fold, of at most approximately one-half of a distance between the fold and the free margin of the first product part, such that the free margin of the first product part is drawn over the support surface and a region of the inner side of the second product part is exposed; and inscribing the second product part in the exposed region, bearing upon the support surface at an inscribing station being assigned to the inscribing section; and for inscribing of an outer side of the first product part, supporting the inner side of the second product part, in the inscribing section, on a further supporting member at a height, as measured from the fold, of at most approximately one-half of a distance between the fold and the free margin of the second product part, whereby the first product part is free of raising by the supporting member such that a region of the outer side of the first product part adjacent to the free margin of said first product part comes into bearing contact with the support surface; and inscribing the first product part in the region bearing upon the support surface adjoining the free margin of the first product part at the inscribing station.

2. The method as claimed in claim 1, wherein each receiving saddle forms together with the supporting member and the further supporting member a receiving unit, which is rotatable about an assigned rotation axis running substantially parallel to the receiving saddle and, for the inscribing of the inner side of the second product part, the first product part is raised by a rotation of the receiving unit in such a way about the rotation axis that a surface area of the first product part, which surface area is supported by the supporting member, slopes substantially obliquely forward in relation to the direction of conveyance (F) and, for the inscribing of the outer side of the first product part, the second product part is raised by a rotation of the receiving unit in such a way about the rotation axis that a surface area of the second product part, which surface area is supported by the further supporting member, slopes substantially obliquely rearward in relation to the direction of conveyance (F).

3. The method as claimed in claim 1, wherein the height, is at least approximately one third of the distance between the fold and the free margin of the first product part and the second product part, respectively.

4. The method as claimed in claim 3, wherein further for inscribing of an outer side of the first product part, the inner side of the second product part rests in the inscribing section on a further supporting member, whereby the first product part is free of raising by the supporting member.

5. An apparatus for inscribing folded printed products which have a first product part and a second product part joined together by a fold and each product part has a free margin running at least approximately parallel to the fold, comprising:

a conveyor device with which the printed products are conveyed one behind the other and with the fold running transversely to a direction of conveyance in the direction of conveyance through an inscribing section;

the conveyor device having receiving saddles, which are disposed transversely to the direction of conveyance and which are intended to convey the printed products deposited astride them;

an inscribing station, assigned to the inscribing section;

a support surface which is assigned to the inscribing section and upon which, for the inscribing, the printed products come to bear;

a supporting member, assigned to each receiving saddle at least in the region of the inscribing section such that, for the inscribing of an inner side of the second product part which trails behind in the direction of conveyance, the leading first product part is drawn over the support surface with its free margin and raised by the supporting member at a height, as measured from the fold, of at most approximately one-half of a distance between the fold and the free margin of the printed product, in order to expose a region of the inner side of the second product part, which region comes to bear upon the support surface;

and, at least in the inscribing section, the receiving saddles are assigned a further supporting member such that the second product part trailing the first product part for an inscribing of the outer side of the first product part is raised in the inscribing section by the further supporting member at a height, as measured from the fold, of at most approximately one-half of a distance between the fold and the free margin of the second product part, such that a region of the outer side of the first product part comes to bear upon the support surface.

6. The apparatus as claimed in claim 5 wherein the supporting member and the further supporting member are fixedly assigned to the respective receiving saddle of the conveyor device and are joined to form a receiving unit having a rotation axis running substantially parallel to the receiving saddle.

7. The apparatus as claimed in claim 6 wherein a distance apart of the receiving saddles in the direction of conveyance (F) is dimensioned such that the printed products, for the inscribing of the outer side of the first product part and the inner side of the second product part in the inscribing section, make simultaneous contact against the support surface both with the region of the outer side of the first product part and with the region of the inner side of the second product part.

8. The apparatus as claimed in claim 6 wherein, for the inscribing of the outer side of the first product part, the receiving unit is rotated in such a way about the rotation axis that a surface area of the second product part, which surface area is supported by the further supporting member, slopes substantially obliquely rearward in relation to the direction of conveyance (F) and, for the inscribing of the inner side of the second product part, the receiving unit is rotated in such a way about the rotation axis that a surface area of the first product part, which surface area is supported by the supporting member, slopes substantially obliquely forward in relation to the direction of conveyance (F).

9. The apparatus as claimed in claim 8 wherein a distance apart of the receiving saddles in the direction of conveyance (F) is dimensioned such that the printed products, for the inscribing of the outer side of the first product part and the inner side of the second product part in the inscribing section, make simultaneous contact against the support surface both with the region of the outer side of the first product part and with the region of the inner side of the second product part.

10. The apparatus as claimed in claim 6 or 8, wherein the rotational position of the receiving units about the rotation axis, upon entry into the inscribing section is preferably controlled by means of a link motion mechanism.

11. The apparatus as claimed in claim 5 wherein a distance apart of the receiving saddles in the direction of conveyance (F) is dimensioned such that the printed products, for the inscribing of the outer side of the first product part and the inner side of the second product part in the inscribing section, make simultaneous contact against the support surface both with the region of the outer side of the first product part and with the region of the inner side of the second product part.

12. The apparatus as claimed in claim 5, wherein the height is at least approximately one third of the distance between the fold and the free margin of the first product part and the second product part, respectively.

13. The apparatus as claimed in claim 5 wherein the supporting member and the further supporting member are fixedly assigned to the respective receiving saddle of the conveyor device and are joined to form a receiving unit having a rotating axis running substantially parallel to the receiving saddle.

14. The apparatus as claimed in claim 13 wherein a distance apart of the receiving saddles in the direction of conveyance (F) is dimensioned such a that the printed products, for the inscribing of the outer side of the first product part and the inner side of the second product part in the inscribing section, make simultaneous contact against the support surface both with the region of the outer side of the first product part and with the region of the inner side of the second product part.

15. The apparatus as claimed in claim 13 wherein, for the inscribing of the outer side of the first product part, the receiving unit is rotated in such a way about the rotation axis that a surface area of the second product part, which surface area is supported by the further supporting member, slopes substantially obliquely rearward in relation to the direction of conveyance (F) and, for the inscribing of the inner side of the second product part, the receiving unit is rotated in such a way about the rotation axis that a surface area of the first product part, which surface area is supported by the supporting member, slopes substantially obliquely forward in relation to the direction of conveyance (F).

16. The apparatus as claimed in claim 15 wherein a distance apart of the receiving saddles in the direction of conveyance (F) is dimensioned such that the printed products, for the inscribing of the outer side of the first product part and the inner side of the second product part in the inscribing section, make simultaneous contact against the support surface both with the region of the outer side of the first product part and with the region of the inner side of the second product part.

17. The apparatus as claimed in claim 13 or 15, wherein the rotational position of the receiving units about the rotation axis, upon entry into the inscribing section is preferably controlled by means of a link motion mechanism.

18. The apparatus as claimed in claim 5 wherein a distance apart of the receiving saddles in the direction of conveyance (F) is dimensioned such that the printed products, for the inscribing of the outer side of the first product part and the inner side of the second product part in the inscribing section, make simultaneous contact against the support surface both with the region of the outer side of the first product part and with the region of the inner side of the second product part.

* * * * *